US005626336A

United States Patent [19]

Adami

[11] Patent Number: 5,626,336

[45] Date of Patent: May 6, 1997

[54] STORAGE AND STACKING DEVICE FOR SHEETS OF LAMINAR MATERIAL

[75] Inventor: Mauro Adami, Lucca, Italy

[73] Assignee: Fosber S.p.A., Lucca, Italy

[21] Appl. No.: 381,742

[22] Filed: Feb. 1, 1995

Related U.S. Application Data

[63] Continuation-in-part of Ser. No. 18,055, Feb. 16, 1993, Pat. No. 5,415,389.

[30] Foreign Application Priority Data

Feb. 20, 1992 [IT] Italy ..... FI92A0042

[51] Int. Cl.[6] ..... B65H 29/68

[52] U.S. Cl. ..... 271/182; 271/203

[58] Field of Search ..... 271/182, 183, 271/189, 190, 202, 203, 85; 198/418.5

[56] References Cited

U.S. PATENT DOCUMENTS

| | | | |
|---|---|---|---|
| 3,724,840 | 4/1973 | Kuckhermann | 271/182 |
| 4,188,861 | 2/1980 | Kroeze et al. | 271/183 |
| 4,240,856 | 12/1980 | Craemer et al. | 271/203 |
| 4,546,871 | 10/1985 | Duke | 271/182 |
| 4,645,194 | 2/1987 | Stobb | 271/203 |
| 4,750,732 | 6/1988 | Hara et al. | 271/182 |
| 4,948,114 | 8/1990 | Bowman et al. | 271/202 |
| 5,100,124 | 3/1992 | Pouliguen | 271/183 |
| 5,158,278 | 10/1992 | Mayer | 271/202 |
| 5,160,132 | 11/1992 | Hanada | 271/183 |
| 5,415,389 | 5/1995 | Adami | 271/203 |

*Primary Examiner*—H. Grant Skaggs
*Attorney, Agent, or Firm*—Francis J. Bouda

[57] ABSTRACT

An automatic storage and stacking device for sheets of laminar material, such as corrugated cardboard or the like, comprises a transportation unit which removes the sheets of laminar material from a cutting group, overlaps them and conveys them towards a storage surface. The transportation unit comprises a plurality of conveyors in series which can be operated at varying speeds so as to allow separation of a first series of sheets from a successive second series of sheets; with one of said conveyors there is associated a retaining means for holding the rear portion of the first sheet of said second series, which retaining means comprises a gripper member able to perform an alternating movement along the conveyor with which said gripper member is associated.

12 Claims, 8 Drawing Sheets

V
71
87
85
33
IV
81
IV
31A
83
31
75
77
31A
9A
56X
79
63
31B
9A
61
9B
9B
56
f55
47
55
9A
9A
57
35
31B
V 33
77
9A
9B
75
47
87
71
31A
85
81
83

STORAGE AND STACKING DEVICE FOR SHEETS OF LAMINAR MATERIAL

This application is a continuation of Ser. No. 08/018,055 filed Feb. 16, 1993 and now U.S. Pat. No. 5,415,389.

BACKGROUND OF THE INVENTION

The invention relates to an automatic storage and stacking device for sheets of laminar material, such as corrugated cardboard or the like, comprising a transportation unit which removes the sheets of laminar material from a cutting group, overlaps them and conveys them towards a storage surface, said transportation unit comprising a plurality of conveyors in series, which can be operated at varying speeds so as to allow separation of a first series of sheets from a successive second series of sheets.

Storage devices of this type are commonly used to remove sheets of stiff corrugated cardboard produced by a cutting unit supplied with a continuous strip of cardboard. These storage devices position the cut sheets in a scale-like arrangement, i.e., so that they partially overlap each other, along a plurality of conveyors in series. At the end of the line of conveyors, the sheets are stored and stacked on a roller table, storage surface or other means. When the stack of sheets is complete, the supply of sheets must be temporarily interrupted, the full storage surface replaced by an empty one and the sheets then supplied again onto the storage surface. In order to perform these operations without stopping the upstream processing line, namely the line for producing and cutting the cardboard sheets and effecting longitudinal ribbing and transverse cutting, use is currently made of conveyor-type storage devices which, by suitably varying the feed speed of the individual conveyors, make it possible to create an interruption in the line of sheets which are in a scale-like and partially overlapped arrangement. The speed variation sequence is such that it is possible to accelerate unloading of the last sheet of a first series of sheets to be stored on the storage surface during filling, at the same time slowing down temporarily the supply of the first sheet of the successive second series of sheets to be stacked on the new storage surface. The interruption is long enough to allow the storage surfaces to be changed over. Plants of this type are known from the prior art and are described, interalia in the U.S. Pat. No. 4,313,600.

In order to slow down the first sheet of the new series and thus ensure continuity in the supply of the sheets, various systems have been proposed for raising temporarily the end of the first sheet of the new series from the transportation unit. Among other things, it has been proposed to hold the end of said sheet using a suction system arranged in the region of one of the conveyors of the transportation line. These known systems have proved to be unreliable since they do not always manage to support the sheet of laminar material or retain it, in particular when the laminar material is buckled or its surface is not smooth, which is often the case on account of the nature of the product.

An object of the present invention is to provide an automatic storage and stacking device of the above-mentioned type which overcomes the drawbacks described above and ensures effective and reliable temporary holding of the rear edge, that is the end, of the first sheet of each series of sheets to be stacked on each storage surface.

These and other objects and advantages, which will become clear to persons skilled in the art upon reading the text which follows, are achieved with an automatic storage and stacking device of the above-mentioned type, characterized in that with one of said conveyors there is associated a retaining means for mechanically holding the rear portion of the first sheet of said second series, which retaining means comprises a gripper member able to perform an alternating movement along the conveyor with which said gripper member is associated, so as to follow the feed movement of the sheet.

According to a particularly advantageous embodiment, during the forward travel in the direction of movement of the conveyor with which it is associated, said gripper member advances at a speed slower than the feed speed of the conveyor with which it is associated and equal to the feed speed of the upstream conveyor.

According to a possible embodiment, the gripper member comprises a carriage accommodating a bar movable with respect to the conveyor with which said gripper member is associated and, above said bar, a member oscillating between an inactive position and a position in which it cooperates with said bar so as to clamp the sheet of laminar material between said bar and said oscillating member.

Advantageously, the conveyor with which the gripper member is associated may consist of a plurality of parallel belts, and the bar may have a plurality of opposition means, each of which extends between two adjacent belts of said conveyor.

DETAILED DESCRIPTION

The invention will be better understood by referring to the description and accompanying drawing, which shows a possible nonlimiting embodiment of said invention. In the drawing, FIG. 1 is an overall schematic side view of the storage and stacking device.

Figure 1:
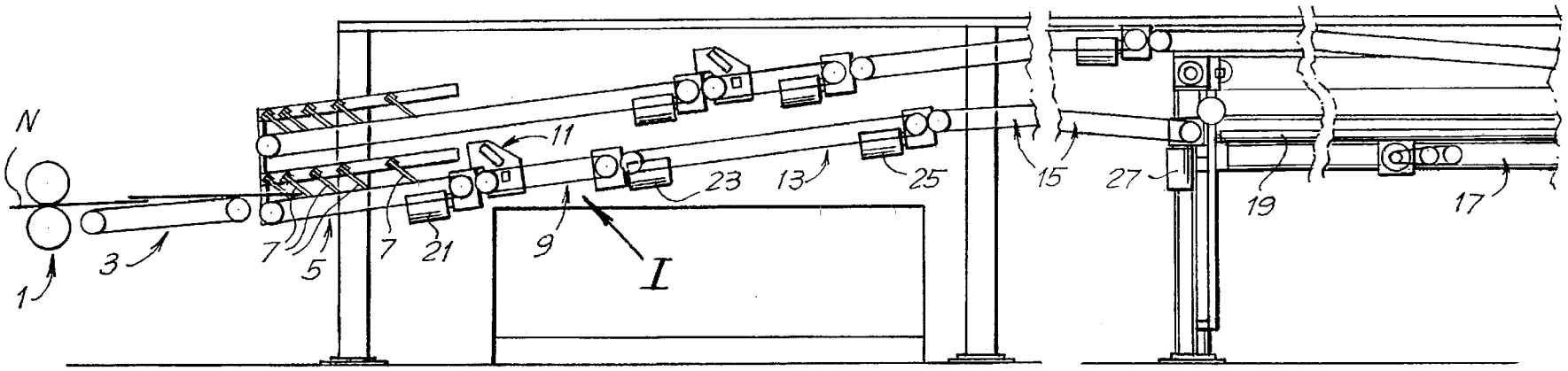
FIGS. 1A, 1B, 1C and 1D show an enlarged view of detail I of FIG. 1 during four phases of separation of two successive series of sheets.

With initial reference to the diagram shown in FIG. 1, the storage and stacking device is arranged downstream of a cutting unit, denoted as a whole by 1, which transversely cuts a strip N of corrugated cardboard, or other similar material, supplied continuously and at a substantially constant speed (indicated below by vN) from the upstream processing units. Downstream of the cutting unit 1 there is arranged a first conveyor equipped with suction means, denoted by 3. The feed speed of the conveyor 3, indicated below by V3, is equivalent to about 1.15–1.20 times the speed vN. This difference in speed ensures that the sheets which are gradually unloaded onto the conveyor 3 are separated from one another and supplied, at intervals with respect to each other, to the next conveyor 5.

Above the conveyor 5 there are arranged brushes 7 which, in a manner known in the art, position the sheets supplied by the conveyor 3 so that they overlap. This operation is made possible by the fact that, under normal working conditions, the feed speed of the conveyor 5 is equal to about 15% of the feed speed of the conveyor 3.

Figure 4:
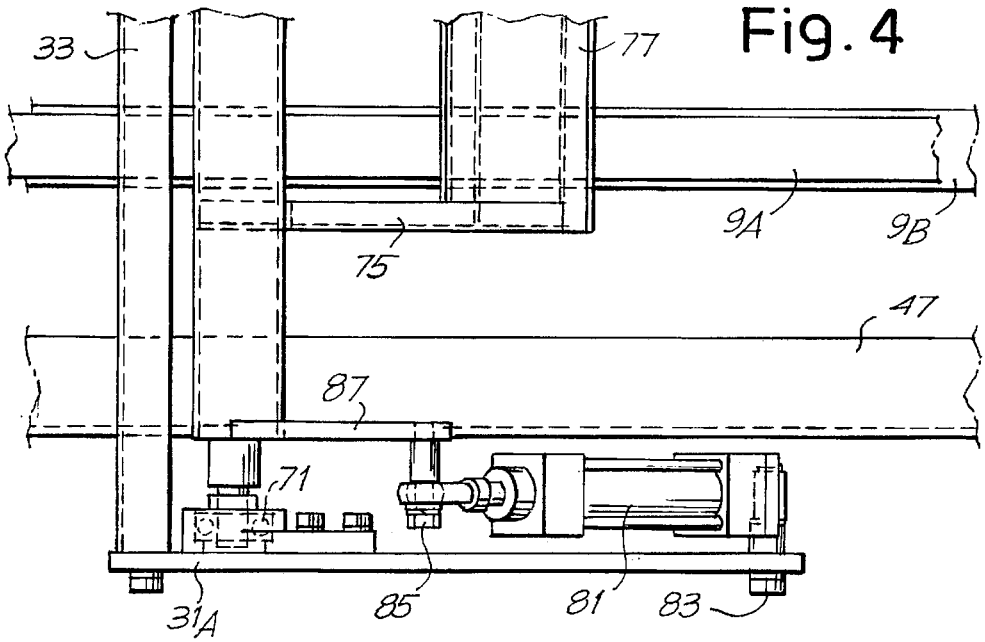
FIG. 4 is a partial plan view along IV—IV of FIG. 2.
Figure 5:
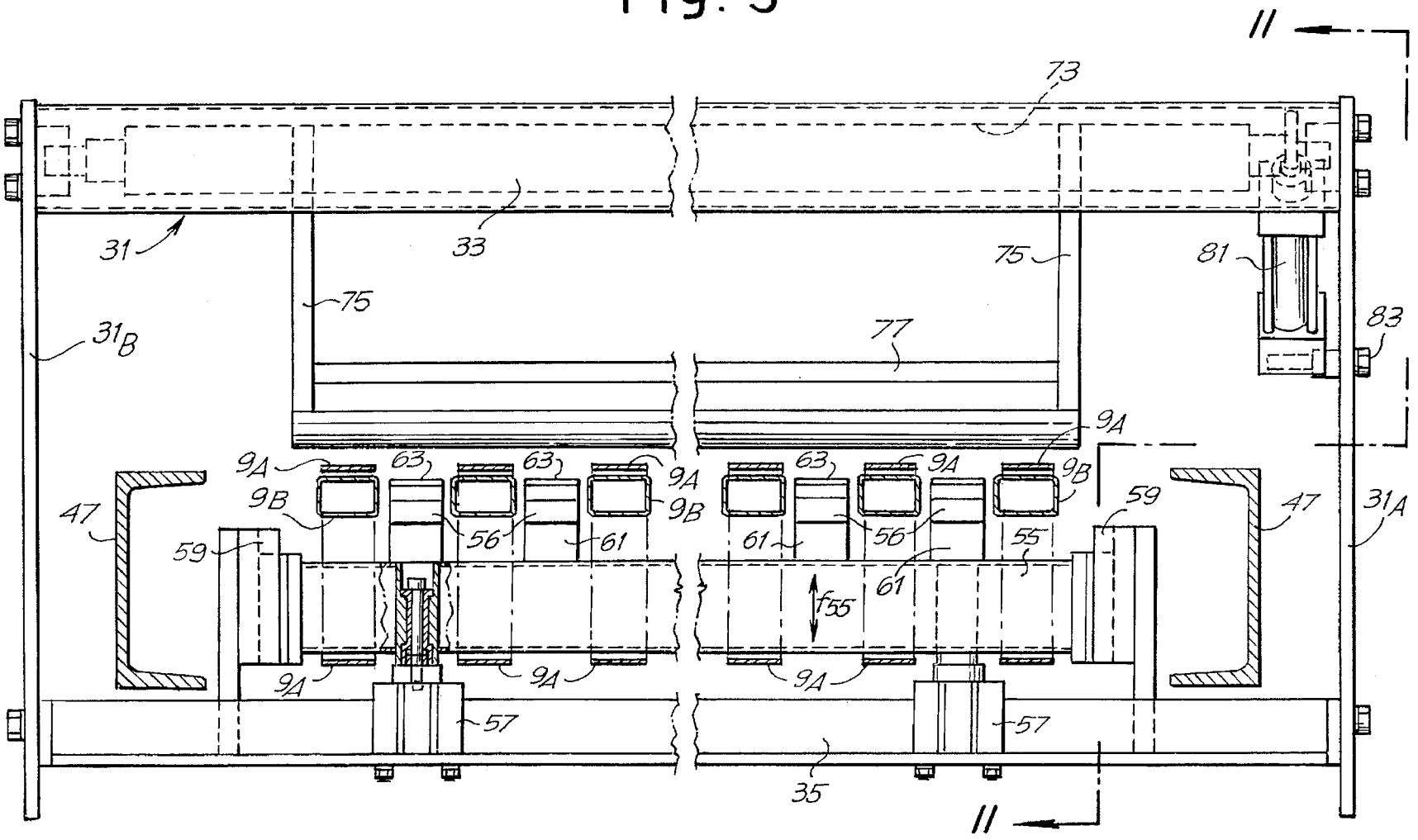
FIG. 5 is a rear view along V—V of FIG. 2.

Downstream of the conveyor 5 there is arranged a further conveyor 9 formed by a plurality of parallel belts, denoted by 9A in FIG. 5, equipped with respective opposition and supporting profiled sections 9B. With the conveyor 9 there is associated a retaining member in the form of a gripper, denoted as a whole by 11 and described in detail with reference to the successive FIGS. 2 to 8. The gripper member 11 is used to separate the first sheet of a second series of sheets conveyed by the storage and stacking device, from the last sheet of the preceding series.

The line for transporting the sheets supplied by the cutting unit 1 is completed by two further conveyors 13 and 15, arranged in series, which unload the sheets supplied by the conveyors upstream onto a storage surface 17 equipped with a roller unit 19 which is vertically movable so as to allow the formation of a stack of sheets. The storage surface 17 and the associated motion mechanism are known in the art and are not described in greater detail.

The conveyors 5, 9, 13, 15 are operated by respective independent actuators 21, 23, 25, 27. The speeds of the conveyors 5, 9, 13 and 15 shall be indicated below by v5, v9, v13 and v15, respectively. Under normal working conditions the four above-mentioned speeds are all the same and equal to about 15% of the feed speed of the conveyor 3.

Above the transportation line formed by the conveyors 5, 9, 13, 15 described above there is arranged a further transportation line which conveys cut sheets from a second cutting unit to a second storage surface, not shown.

When the stack of sheets of laminar material on the storage surface 17 is complete and said surface must therefore be replaced with a new empty surface, namely the stack of sheets must be unloaded from the roller unit 19, the control unit of the storage device causes a variation in the feed speed of the individual conveyors 5, 9, 13, 15. This separates the last sheet belonging to the series of sheets to be stacked on the storage surface 17 which is nearly full, from the first sheet of the next series which is to form the new stack.

More particularly, the separation stage is performed as follows. The number of sheets cut is counted by cutting unit 1. As soon as the programmed number of sheets has been reached, i.e. as soon as the number of sheets to be stacked in a single stack has been cut by cutting unit 1, a counter combined therewith gives a signal and the last sheet of the first series is tracked until it reaches the gripper 11 and passes it. As soon as this happens, i.e. as soon as the last sheet of the first series has cleared off the gripper 11, the central unit increases the speed of the conveyors 9, 13 and 15 to a speed equal, for example, to 30% of the speed of the conveyor 3. At the same time, the feed speed of the conveyor 5 is reduced from 15 to 5% of the speed of the conveyor 3 and the gripper member 11 clamps, in the manner described below, the end of said first sheet of the new series (and the sheets resting on it), raising it from the conveyor 9.

Simultaneously, the gripper member 11 starts to move forward in the same direction of movement as the conveyors, at a speed v11 equal to the feed speed v5 of the conveyor 5, namely at 5% of the feed speed of the conveyor 3. The forward movement of the gripper member 11 stops when the latter reaches the downstream end of the conveyor 9. At this point, the gripper member releases the end of the sheet, allowing the latter to pass to the conveyor 13, and starts the return travel towards the start of the conveyor 9, while the speed of the conveyor 5 remains at the value of 5% of the speed v3.

The speed of the conveyor 9 remains at 30% of the speed v3 of the conveyor 3 until the end of the last sheet of the first series has passed onto the conveyor 13. At this point the conveyor 9 can be slowed down to a speed equal to 5% of v3, i.e., to the speed of forward movement of the gripper member 11. In this way, the following sheets being fed forward behind the gripper member 11 are able to deposit themselves on the conveyor 9 which is advancing at the same speed as them.

As soon as the encoder means associated with the conveyors indicates the passage of the last sheet of the first series from an upstream conveyor to the respective downstream conveyor, the first sheet is slowed down. For example, as soon as the encoder indicates the passage of the last sheet of the first series from the conveyor 13 to the conveyor 15, conveyor 13 is slowed down from 30% to 5% of the speed v3. The following table summarizes the values for the speeds of the individual conveyors and gripper 11 expressed as a percentage of v3:

| | CONVEYOR | | | | |
|---|---|---|---|---|---|
| | v5 | v11 | v9 | v13 | v15 |
| Percentage | 15 | 0 | 15 | 15 | 15 |
| of | 5 | 5 | 30 | 30 | 30 |
| speed | 5 | 5 | 5 | 30 | 30 |
| conveyor v3 | 5 | −5 | 5 | 30 | 30 |
| | 5 | 0 | 5 | 5 | 30 |
| | 5 | 0 | 5 | 5 | 5 |
| | 15 | 0 | 15 | 15 | 15 |

Figure 1A:
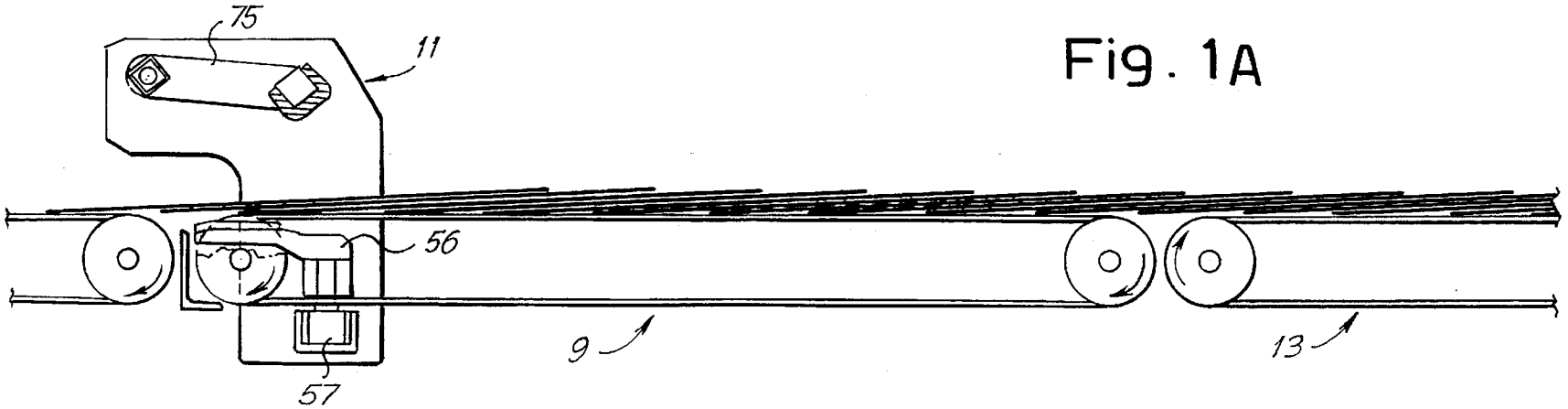
Figure 1B:
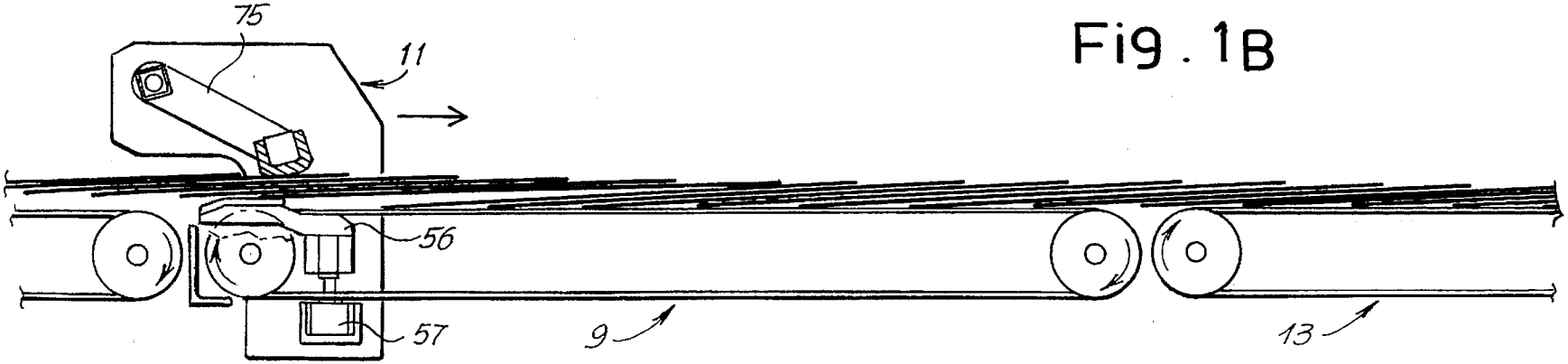
Figure 1C:
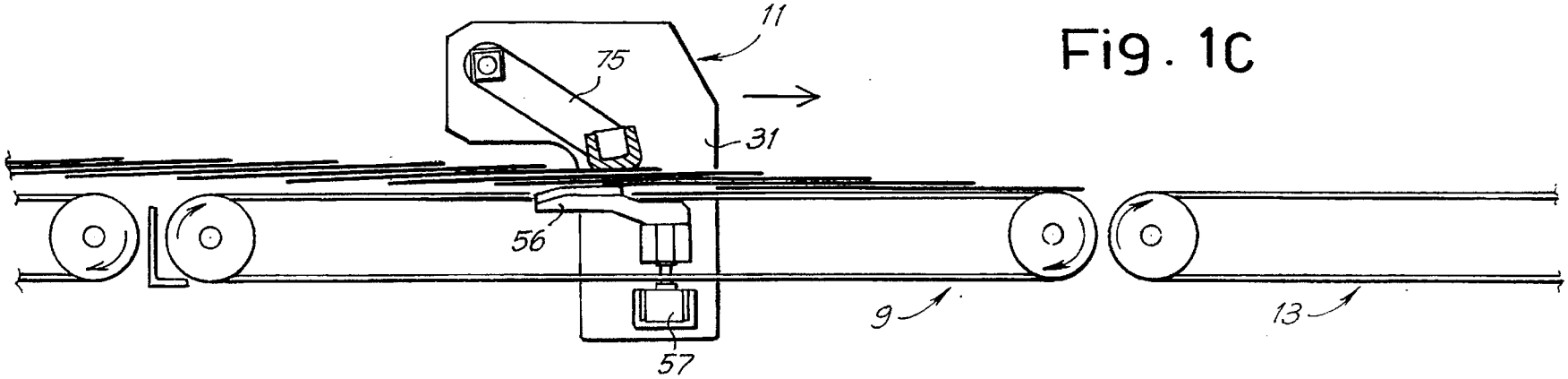
Figure 1D:
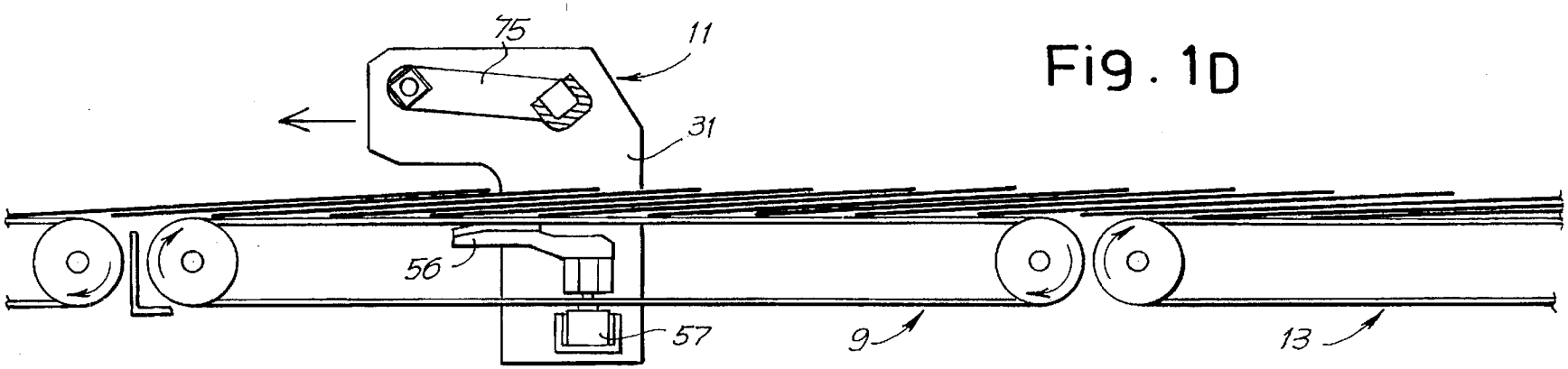

FIGS. 1A to 1D show four successive phases during the operation separating the last sheet of the first series from the first sheet of the second series. In FIG. 1A the sheets are still perfectly aligned with a constant interval, the conveyors 9 and 13 are advancing at the same speed and the gripper member is deactivated. In FIG. 1B the gripper member 11 has clamped the first sheet of the second series and has raised it from the conveyor 9, while the speed of the latter and of the conveyor 13 is increased. In FIG. 1C the first sheet of the second series is about to be unloaded onto the conveyor 13. During this phase the conveyor 5, the conveyor 9 and the gripper member 11 are advancing slowly at the same speed. In FIG. 1D the zone for transmission from the first to the second series of sheets has already passed beyond the conveyor 9 and the gripper member 11 returns to the starting position.

The gripper member 11 will be described below with reference to FIGS. 2 to 8.

Figure 6:
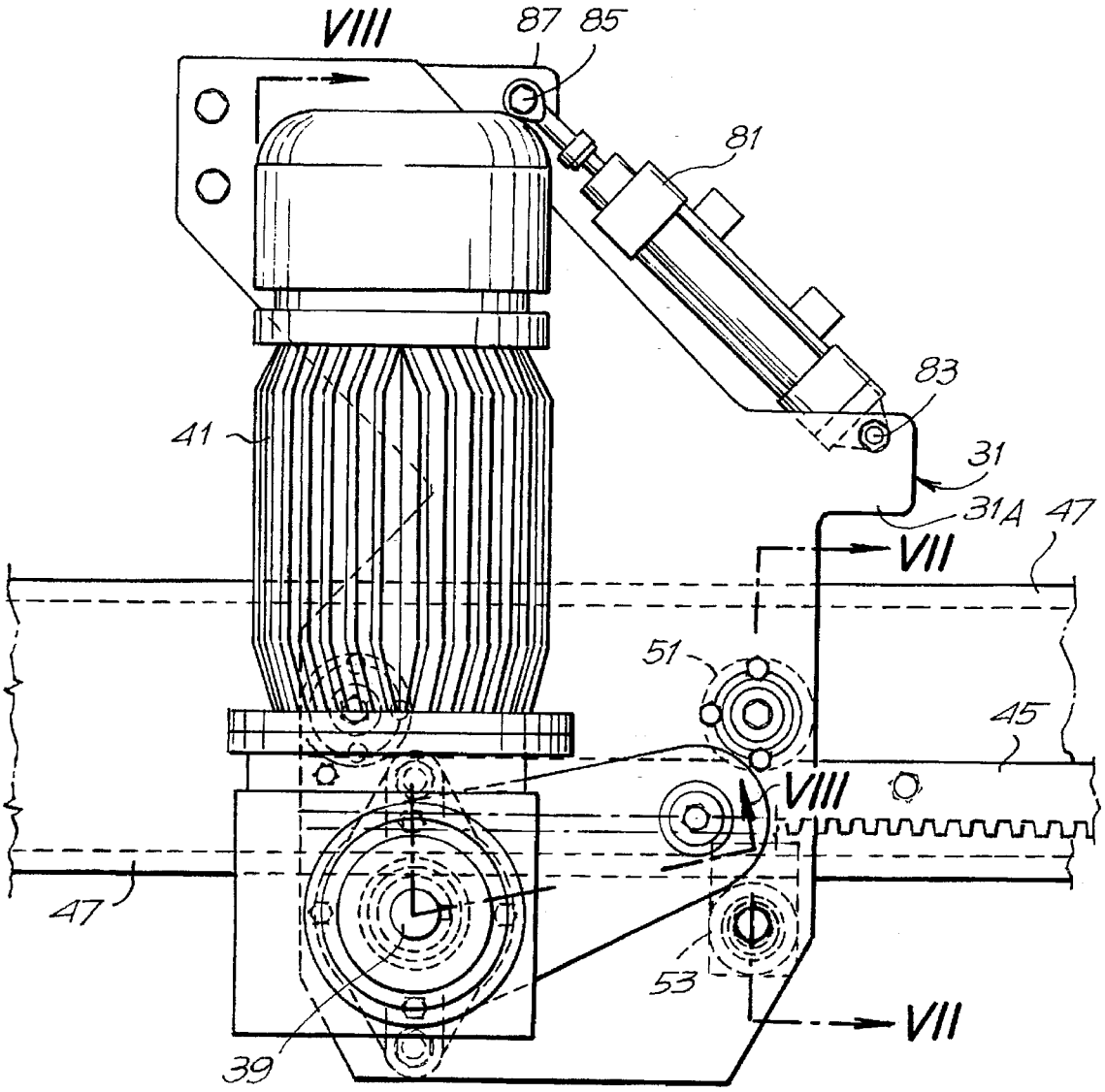
FIG. 6 is a side view of the carriage accommodating the gripper member, with the motor mounted.
Figures 7, 8:
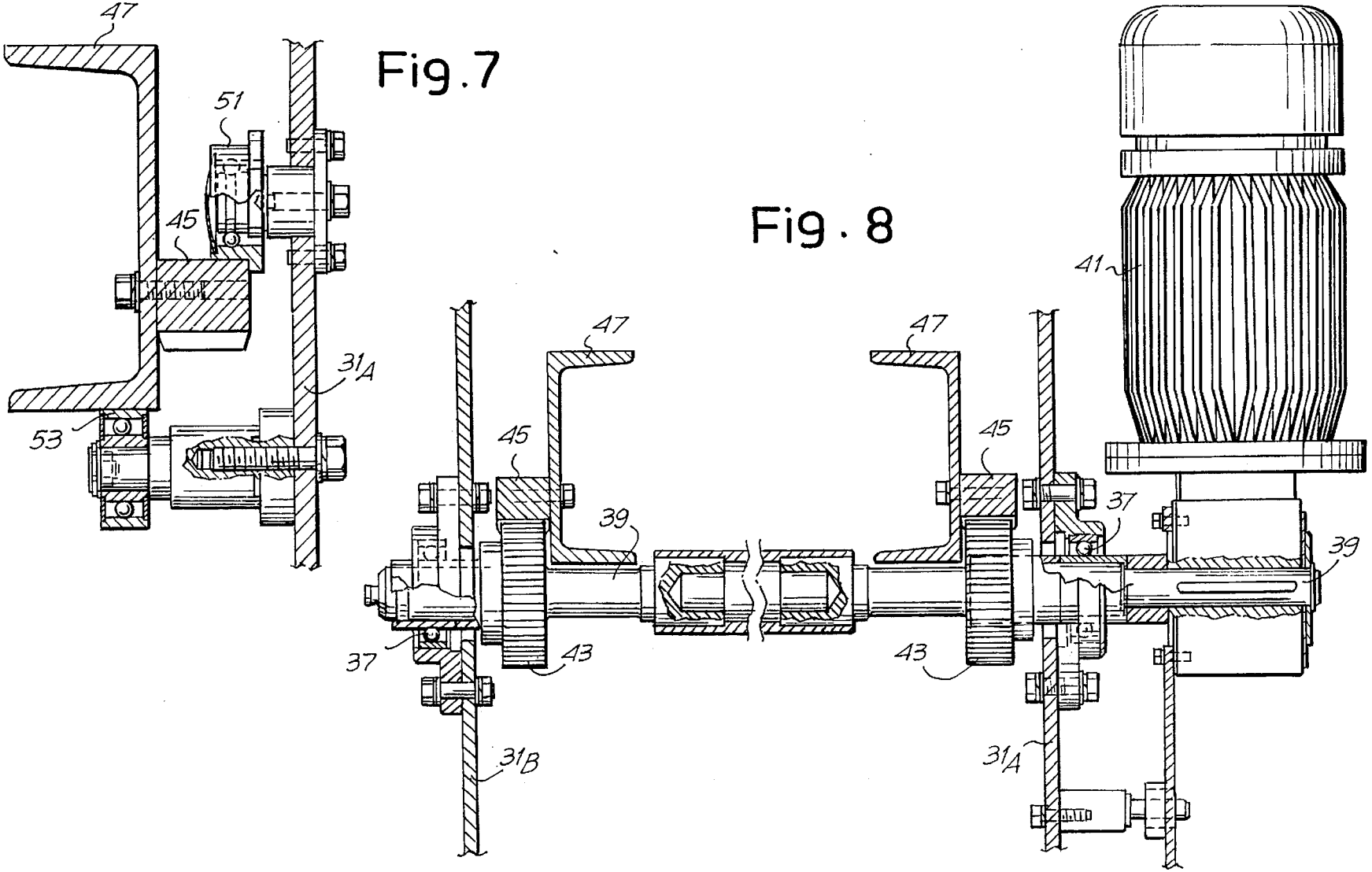
FIGS. 7 and 8 are sections along VII—VII and VIII of FIG. 6.

The gripper member 11 is mounted on a carriage 31 composed of two flanks 31A, 31B connected by an upper cross-piece 33 and a lower cross-piece 35. The two flanks 31A, 31B support, via bearings 37, a drive shaft 39 (see in particular FIG. 8) made to rotate by a motor 41, which constitutes the actuator determining the translational movement of the gripper member 11 along the corresponding conveyor 9. Two pinions 43 are keyed onto the drive shaft 39 and mesh with corresponding racks 45 mounted on two beams 47. These beams 47 have mounted on them the shafts onto which are keyed the drive pulleys for the belts 9A forming the transportation unit 9. The cross-section in FIG. 5 shows only the belts 9A, while the drive pulley system has been omitted, for the sake of greater clarity of the drawing. The movement of the carriage 31 along the beams 47 and hence along the conveyor 9 is guided by means of two pairs of idle rollers 51 and 53 mounted on the two flanks 31A and 31B of the carriage 31 (FIGS. 6 and 7).

Figure 2:
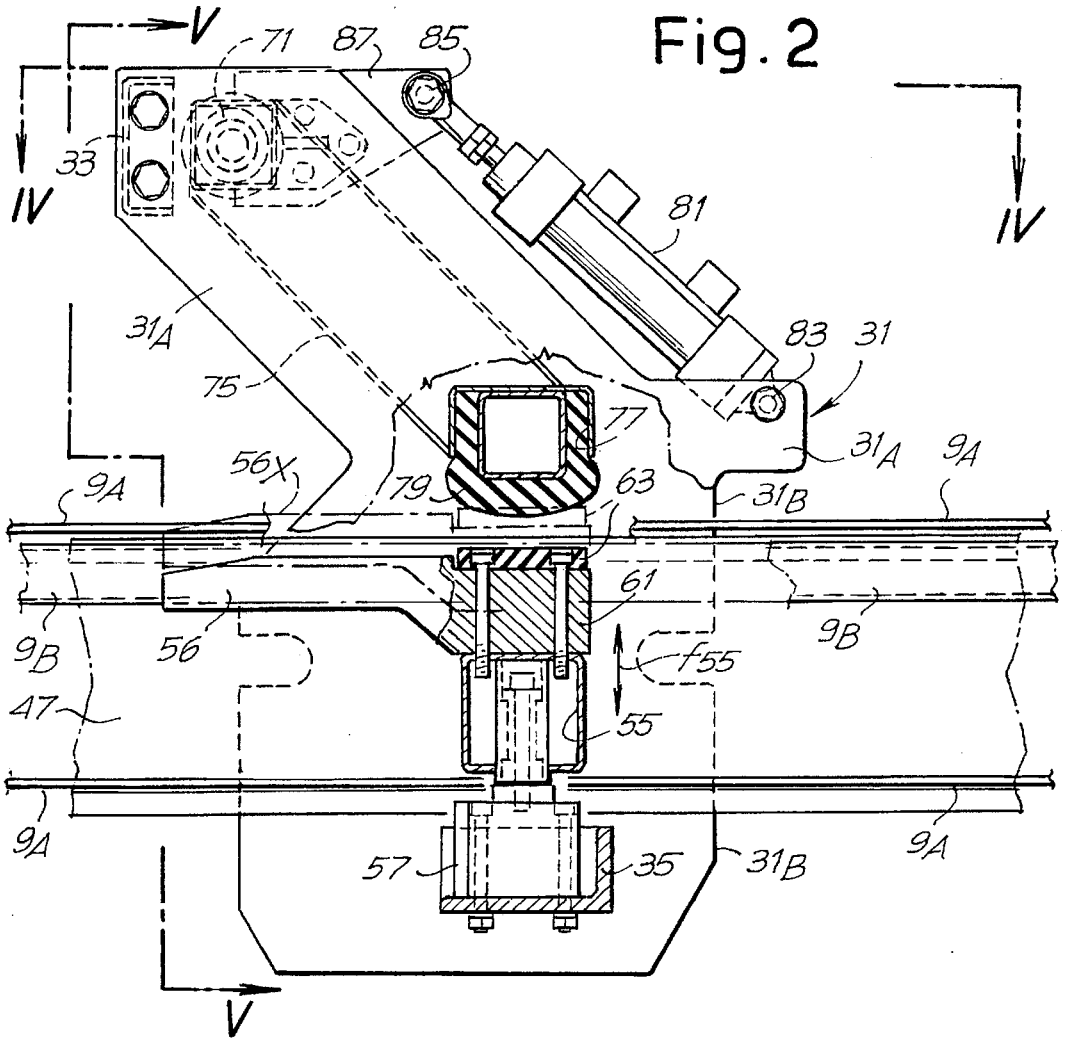
FIG. 2 is a side view, along II—II of FIG. 5, of the carriage accommodating the gripper member in the partially closed position, the motor having been removed.
Figure 3:
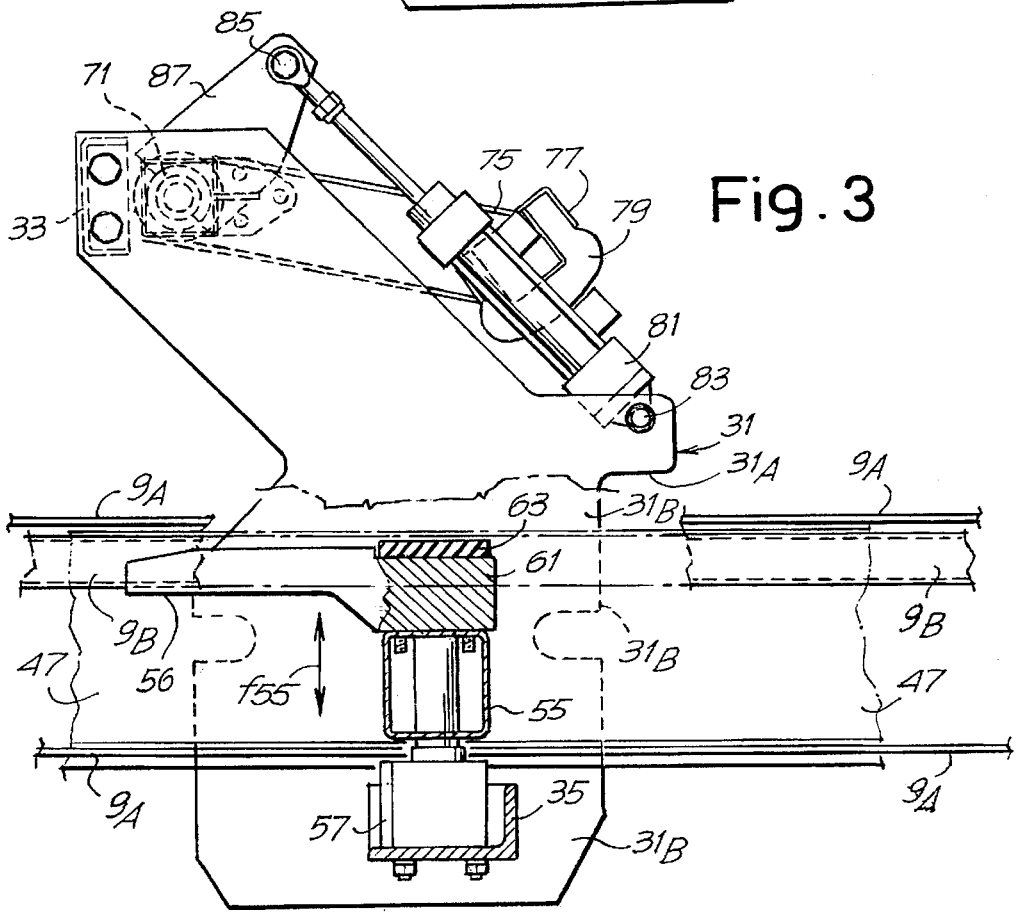
FIG. 3 is a view corresponding to that of FIG. 2, with the gripper in the open position.

The lower cross-piece 35 has mounted on it a transverse bar 55 movable vertically in the direction of the double arrow f55 (see FIGS. 2, 3 and 5). The vertical movement of the bar 55 is obtained by means of cylinder/piston actuators 57 mounted on the lower crosspiece 35. During the vertical movement the bar 55 is guided by means of lateral guides 59.

On the bar 55 there are arranged opposition means 61 which have on them layers of rubber or other friction material 63 and which form, moreover, receiving profiles 56 for facilitating transfer of the sheets of laminar material. Each opposition means 61 is arranged between two adjacent belts 9A so as to be able to project between the latter when the bar 55 is raised.

At the top of the transverse bar 33, a transverse shaft 73 is mounted, via bearings 71, between the two flanks 31A, 31B of the carriage 31 (see in particular FIG. 4). Two arms 75 are integral with the transverse shaft 73 and support a U-shaped section 77 on which there is mounted a buffer element made of rubber or the like, denoted by 79. The arms 75, the U-shaped section 77 and the transverse buffer element 79 form an oscillating member intended to cooperate with the underlying transverse bar 55 so as to clamp the edge of the sheet of laminar material, in the manner described above.

The oscillating movement of the oscillating member 75, 77, 79 is controlled by a cylinder/piston actuator 81 hingeably connected, at 83, to the flank 31A of the carriage and, at 85, to a bracket 87 integral with the transverse shaft 73. Owing to the action of the cylinder/piston actuator 81, the oscillating member 75, 77, 79 oscillates between the two positions indicated in FIGS. 2 and 3, respectively. FIG. 2 shows the oscillating member in the position, i.e., in the position where it cooperates with the underlying transverse bar 55 so as to clamp the sheets of laminar material located between them. For this purpose and in order to keep the sheet raised above the belts 9A of the transportation unit 9, the bar 55 and the profiles 56 are raised (via the cylinder/piston systems 57) from the position shown in solid lines in FIG. 2 to the position shown in dot-dash lines and marked 56X. In this position of the bar 55, the sheets are raised above the belts 9A and are, therefore, able to advance at a different speed compared to the feed speed of the transportation unit 9.

Figure 2A:
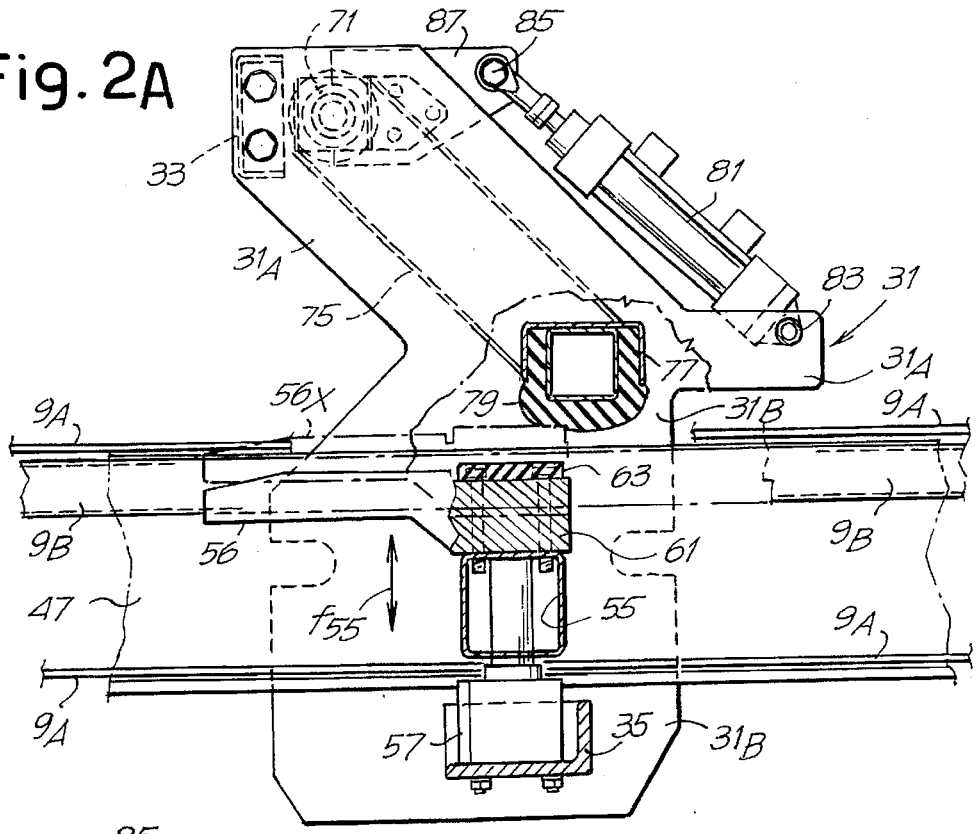

FIG. 2A shows, for example, a modification of the gripper member 11. According to this modified embodiment, the arms 75 are pivotally engaged to the flanks 31A, 31B of the carriage 31 in a position which is slightly more advanced than that shown in FIG. 2. In this way when the gripper means is closed in order to grip the first sheet of a new series of sheets, the transverse buffer element 79 presses the end of the first sheet of said new series against layer 63, and at the same time presses the end of the last sheet of the previous series against the parallel belts 9A forming the conveyor 9. This second pressing action increases the friction between the conveyor 9 and the last sheet of the previous series and makes transfer of the last sheet easier.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what is claimed as new and desired to protect by Letters Patent are the following:

1. An automatic storage and stacking device for sheets of laminar material, such as corrugated cardboard or the like, comprising a conveyor including a transportation unit which removes the sheets of laminar material from a cutting group, overlaps said sheets and conveys them towards a storage surface, said transportation unit including a plurality of conveyors in series, with means to move said conveyors at varying speeds so as to allow separation of a first series of sheets from a successive second series of sheets; and combined with one of said conveyors a means for lifting the first sheet of said second series, characterized in that said lifting means includes a gripper member associated with said one of said conveyors and including an upper and a lower gripping means which are reciprocatingly moved along said one of said conveyors with which said gripper member is associated, and that said lower gripping means is arranged below the trajectory of said overlapped sheets and said upper gripping means is arranged above the trajectory of said overlapped sheets, said lower gripping means being movable from a first position wherein it is clear of the sheets, to a second position wherein it lifts said first sheet from said one of said conveyors with which said gripper member is associated.

2. A storage device according to claim 1 characterized in that, during the forward travel in the direction of movement of said one of said conveyors with which it is associated, said gripper member advances at a speed slower than the feed speed of the conveyor with which it is associated and equal to the feed speed of an upstream conveyor.

3. An automatic storage and stacking device for sheets of laminar material, such as corrugated cardboard or the like, comprising a conveyor including a transportation unit which removes the sheets of laminar material from a cutting group, overlaps said sheets and conveys them towards a storage surface, said transportation unit including a plurality of conveyors in series, with means to move said conveyors at varying speeds so as to allow separation of a first series of sheets from a successive second series of sheets; and combined with one of said conveyors a means for lifting the first sheet of said second series, characterized in that said lifting means includes a gripper member associated with said one of said conveyors able to perform a reciprocating movement along said one of said conveyors with which said gripper member is associated, and that said gripper member includes a lower gripping means which is arranged below the trajectory of said overlapped sheets and an upper gripping means arranged above the trajectory of said overlapped sheets, said lower gripping means being movable from a first position wherein it is clear of the sheets, to a second position wherein it lifts said first sheet from said one of said conveyors with which said gripper member is associated, and that, during the forward travel in the direction of movement of said one of said conveyors with which it is associated, said gripper member advances at a constant speed and said one of said conveyors with which it is associated advances at a faster speed for a period of time necessary for unloading the last sheet of the first series and subsequently at a slower speed equal to the speed of forward movement of the gripper member.

4. An automatic storage and stacking device for sheets of laminar material, such as corrugated cardboard or the like, comprising a conveyor including a transportation unit which removes the sheets of laminar material from a cutting group, overlaps said sheets and conveys them towards a storage surface, said transportation unit including a plurality of conveyors in series, with means to move said conveyors at varying speeds so as to allow separation of a first series of sheets from a successive second series of sheets; and combined with one of said conveyors a means for lifting the first sheet of said second series, characterized in that said lifting means includes a gripper member associated with said one of said conveyors able to perform a reciprocating movement along said one of said conveyors with which said gripper member is associated, and that said gripper member includes a lower gripping means which is arranged below the trajectory of said overlapped sheets and an upper gripping means arranged above the trajectory of said overlapped sheets, said lower gripping means being movable from a first position wherein it is clear of the sheets, to a second position wherein it lifts said first sheet from said one of said conveyors with which said gripper member is associated, and that said gripper member comprises a carriage including a bar arranged transversely with respect to said one of said conveyors with which said gripper member is associated and, above said bar, a clamp member oscillating between an inactive position and a position in which it cooperates with said bar, so as to clamp the sheet of laminar material between said bar and said oscillating clamp member, said bar being vertically movable so as to cooperate with said oscillating clamp member.

5. A storage device according to claim 4 characterized in that said one of said conveyors with which said gripper member is associated includes an upper and a lower arm and said bar is arranged between the upper arm and the lower arm.

6. A storage device according to claim 5 characterized in that said one of said conveyors with which the gripper member is associated consists of a plurality of parallel belts and in that said bar has a a plurality of opposition means, each of which extends between two adjacent belts of said conveyor.

7. A storage device according to claim 6 characterized in that said opposition means are equipped with rubber-lined surfaces.

8. A storage device according to claim 4 characterized in that a receiving profile for incoming sheets is associated with said bar.

9. A storage device according to claim 4 characterized in that said oscillating member has a rubber-lined surface designed to act on the sheet of laminar material.

10. A storage device according to claim 4, characterized in that said carriage supports a first actuator means for controlling the forward and backward movement of the carriage along the associated conveyor, a second actuator means for controlling the oscillating movement of said oscillating member, and a third actuator means for controlling the upward and downward movement of said bar.

11. A storage device according to claim 10 characterized in that said first actuator means controls rotation of a pinion meshing with a rack mounted on the supporting structure of said one of said conveyors with which the gripper member is associated.

12. A storage device according to claim 10 characterized in that said second actuator means is a cylinder/piston system.

* * * * *